United States Patent [19]

Boyadjieff et al.

[11] 4,365,676

[45] Dec. 28, 1982

[54] METHOD AND APPARATUS FOR DRILLING LATERALLY FROM A WELL BORE

[75] Inventors: George I. Boyadjieff, Anaheim; Andrew B. Campbell, San Marino, both of Calif.

[73] Assignee: Varco International, Inc., Orange, Calif.

[21] Appl. No.: 180,695

[22] Filed: Aug. 25, 1980

[51] Int. Cl.[3] ..... E21B 4/18; E21B 7/04; E21C 1/10; E21C 5/11

[52] U.S. Cl. ..... 175/61; 175/62; 175/77; 175/78

[58] Field of Search ..... 175/61, 62, 77, 78, 175/52

[56] References Cited

U.S. PATENT DOCUMENTS

| | | | |
|---|---|---|---|
| 1,367,042 | 2/1921 | Granville | 175/62 |
| 1,850,403 | 3/1932 | Lee | 175/78 |
| 2,251,916 | 8/1941 | Cross | 175/62 |
| 2,325,565 | 7/1943 | Williams | 175/62 |
| 2,699,920 | 1/1955 | Zublin | 175/78 |
| 2,947,518 | 8/1960 | Garrett et al. | 175/78 |
| 3,032,106 | 5/1962 | Focht et al. | 166/341 |
| 3,477,762 | 11/1969 | Frenyo et al. | 175/62 |
| 3,598,445 | 8/1971 | Winberg | 175/61 |
| 3,776,595 | 12/1973 | Winberg | 299/31 |
| 3,827,512 | 8/1974 | Edmond | 175/62 |
| 3,888,319 | 6/1975 | Bourne, Jr. | 175/76 |
| 3,958,649 | 5/1976 | Bull et al. | 175/61 |
| 4,007,797 | 2/1977 | Jeter | 175/61 |
| 4,051,908 | 10/1977 | Driver | 175/78 |
| 4,095,655 | 6/1978 | Still | 175/19 |

*Primary Examiner*—Stephen J. Novosad
*Attorney, Agent, or Firm*—William P. Green

[57] ABSTRACT

A hole is drilled laterally from a main well bore by lowering a drilling unit into the bore in a position of extension essentially longitudinally thereof, and then swinging the unit to a position of extension transversely of the well bore to drill the lateral hole. The drilling unit is desirably held by a carrier as the drilling unit and carrier are lowered into the well, and preferably is of a self-propelling character adapted to move entirely out of the carrier and grip the wall of the lateral hole in a manner transmitting the reactive forces of the drilling operation directly to the earth formation.

38 Claims, 10 Drawing Figures

METHOD AND APPARATUS FOR DRILLING LATERALLY FROM A WELL BORE

BACKGROUND OF THE INVENTION

This invention relates to improved apparatus and methods for drilling holes laterally from a well bore.

In various well drilling situations, it may become desirable to first drill downwardly into the earth to a predetermined depth, and then at that depth drill one or more holes laterally from the main bore, either directly horizontally or at an inclination having a component transversely of the main well bore. For example, in a coal gasifying operation, a generally horizontal hole may extend between the lower ends of two vertical bores, to enable subjection of coal surrounding the horizontal hole to treatment in a manner converting the coal to a combustible natural gas.

Conventional directional drilling procedures are often inconvenient or ineffective for producing such a horizontal hole, since most conventional processes are incapable of changing the direction of a hole from vertical to horizontal as abruptly as might be desired. Instead, it is usually necessary to direct the drilling bit along a gradually curving path in changing to a horizontal condition. Further, the equipment required for conventional directional drilling may be relatively bulky, and expensive in both initial cost and operation and in other ways unsuited for use in recovering energy from coal.

SUMMARY OF THE INVENTION

The present invention provides improved drilling methods and apparatus which enable the direction in which a well is being drilled to be changed abruptly at any desired level, in a manner very accurately locating a laterally extending hole relative to a coal seam or other earth formation. The equipment utilized for the purpose is structurally very simple and easy to control and operate and permits drilling of a lateral hole at very low cost.

Apparatus embodying the invention includes a drilling unit which is self-contained and self-propelling through the earth, and includes a gripping structure adapted to engage the sidewall of a hole being drilled in a relation transmitting reactive forces of the drilling operation directly to that wall, together with means for advancing a drilling bit relative to the gripping structure to form the hole. After the bit has drilled through a predetermined distance, the gripping structure may be advanced relative to the bit to engage the wall of the hole at a location advanced from its initial point of engagement in order to transmit reactive forces to the wall of the hole at an advanced location for drilling an additional distance into the earth. A second gripping structure of the drilling unit may engage and grip the wall of the hole to prevent retraction of the bit as the first mentioned gripping structure is advanced from one location to the next location, all with the result that the overall drilling unit is able to progressively advance through the earth as a self-contained self-propelling unit.

The drilling unit is adapted to be lowered into the well in a position in which the drilling axis of the bit extends essentially longitudinally of the main well bore, and is mounted to turn from such a longitudinally extending position to a position in which the axis extends more transversely of the main well bore so that upon actuation of the drilling unit it then forms the desired laterally extending hole. The drilling unit is preferably initially held by a carrier, which may take the form of a hollow case containing the drilling unit, and which is lowerable into the well with the drilling unit. When the carrier and case reach the location of the desired lateral hole, these two structures may swing together from a position of extension longitudinally of the main well bore to a transversely extending condition, in which the drilling unit is able to advance progressively from the carrier in a transverse or horizontal direction and into the adjacent earth formation. When the drilling of the lateral hole has been completed, the drilling unit can be withdrawn from the hole and well bore by a cable connected to it and actuable from the surface of the earth. Such withdrawal can be facilitated by lowering a removal tool into the main well bore, with that tool having a portion receivable at essentially the juncture of the main well bore and the lateral hole and acting to direct the withdrawing cable from horizontal to vertical condition at that location.

BRIEF DESCRIPTION OF THE DRAWINGS

The above and other features and objects of the invention may be better understood from the following detailed description of the typical embodiment illustrated in the accompanying drawings, in which.

DESCRIPTION OF THE PREFERRED EMBODIMENT

Figure 1:
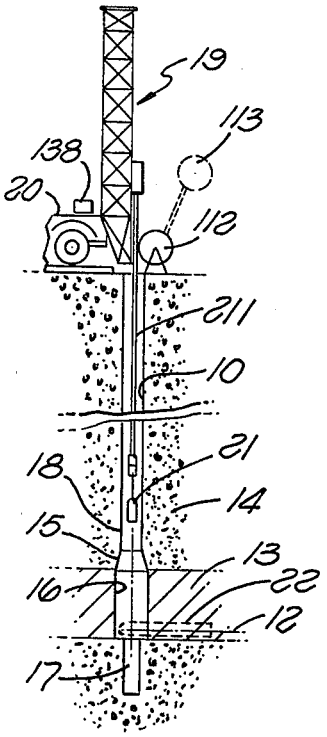
FIG. 1 is a diagrammatic representation of a well within which a drilling unit embodying the invention is being lowered.

In FIG. 1, there is represented at 10 a well bore which has been drilled downwardly into the earth, typically along a directly vertical axis 11, and from which an auxiliary hole is to be drilled laterally, typically along a directly horizontal axis 12, at a location spaced beneath the surface of the earth. The intended path of the lateral hole may for example be within a seam 13 of coal running horizontally beneath an overburden 14, and may be such as to connect the main well bore 10 with a second vertical bore by means of the horizontal hole to enable gasification of the coal and recovery of the gases through one of the vertical bores, or to enable performance of other coal recovery operations in which two horizontally connected vertical wells are employed.

The well bore 10 may be drilled at a uniform diameter to a level 15, and be underreamed beneath that point to form an increased diameter underground cavern 16 at the level of the coal seam 13. A reduced diameter bore 17 may be drilled into the earth beneath the underreamed region 16 to provide a sump for reception of cuttings produced in the horizontal drilling operation. A casing 18 may be positioned in the well bore 10 down to the level 15.

The main bore 10 may be drilled by a conventional drilling rig which is illustrated diagrammatically in FIG. 1 at 19, and which in the case of the shallow type wells employed in most coal recovery operations may be of light construction and mounted on a vehicle 20. This same rig may be employed for lowering into the well an assembly 21 formed in accordance with the present invention and operable to drill the lateral hole 22 into the earth formation along axis 12. Assembly 21 includes a self-propelling drilling unit 23 and a carrier or case 24 which holds the drilling unit as it is lowered into the main well bore and during the initial portion of the horizontal drilling operation. Assembly 21 may be carried at the lower end of a string 211 of drill pipe, which is lowered progressively into the main well bore 10 far enough to locate the assembly 21 in the broken line position of FIG. 1 from which the horizontal drilling operation proceeds.

The carrier 24 is a hollow somewhat elongated housing part or case having a cylindrical side wall 25 which is centered about an axis 26 and has an open end defined by a circular end edge 27 lying in a plane 28 disposed transversely of axis 26. At its opposite end, carrier 24 has a convexly rounded end wall 29. The cylindrical wall 25 of the carrier may be continuous except at the location of an elongated slit or opening 30 extending axially along the entire length of the top portion of the carrier, and a typically circular opening 31 formed in the bottom of cylindrical wall 25 at a location approximately midway between the opposite ends of the carrier for reception over and in communication with the bottom portion 17 of the main well bore in the FIG. 4 position of the equipment.

Carrier 24 is movably suspended from a part 32 which is threadedly connected to the lower end of the drill string 211. A first pair of links 33 and a second pair of links 34 connect carrier 24 to part 32 in a manner enabling pivotal movement of the carrier and contained drilling unit from the vertical position of FIG. 2 in which the device is lowered into the well bore to the horizontal position of FIG. 4 in which the lateral hole is drilled. The two links 33 are pivotally connected at 35 to opposite sides of carrier 24, at diametrically opposite locations, in a manner enabling pivotal movement of the carrier relative to the lower ends of links 33 about a horizontal axis 36. The upper portions of links 33 contain identical vertical slots 37 within which a pin 38 connected to the lower end of part 32 is slidably received and confined. Pin 38 may be rigidly secured to part 32 and extend horizontally (transversely of the longitudinal axis 11 of the drill string) along a transverse axis 39. This pin and slot connection between parts 32 and 33 enables links 33 to move upwardly and downwardly relative to part 32 between the positions of FIGS. 2 and 4.

The two additional links 34 may be pivotally connected at their upper ends to pin 38, for relative pivotal movement about axis 39, and are pivotally connected at their lower ends 40 to carrier 24 at diametrically opposite locations near the closed end wall 29 of the carrier. The axis 139 of the pivotal connections between links 34 and the carrier is parallel to pivotal axes 36 and 39. A cable 41 is connected at 42 to the open end of carrier 24, and acts when pulled upwardly from the surface of the earth to swing the open end of the carrier upwardly to the FIG. 4 position, with simultaneous upward sliding movement of links 33 to their FIG. 4 positions in which this sliding movement is limited by engagement of pin 38 with the lower ends of slots 37. As the open end of the carrier is thus swung upwardly, the closed end of the carrier is retained against more than a very limited amount of upward movement by virtue of the pivotal connection of the opposite ends of links 34 to parts 32 and 24 at fixed axes, with the result that the carrier and contained drilling unit swing to the position of FIG. 4 in which their common axis 26 extends directly transversely of the axis of the drill string and bore 10, and therefore directly horizontally when bore 10 is exactly vertical. The relative proportions of the links 33 and 34 are such as to assure that the swinging movement of the carrier induced by exertion of upward pulling force on cable 41 will be positively limited in this position of FIG. 4. Alternatively, the relative lengths of the links may be altered to locate the carrier and drilling unit in any desired position of oblique angularity with respect to the axis of the main well bore, if a non-perpendicular hole is desired.

Figure 6:
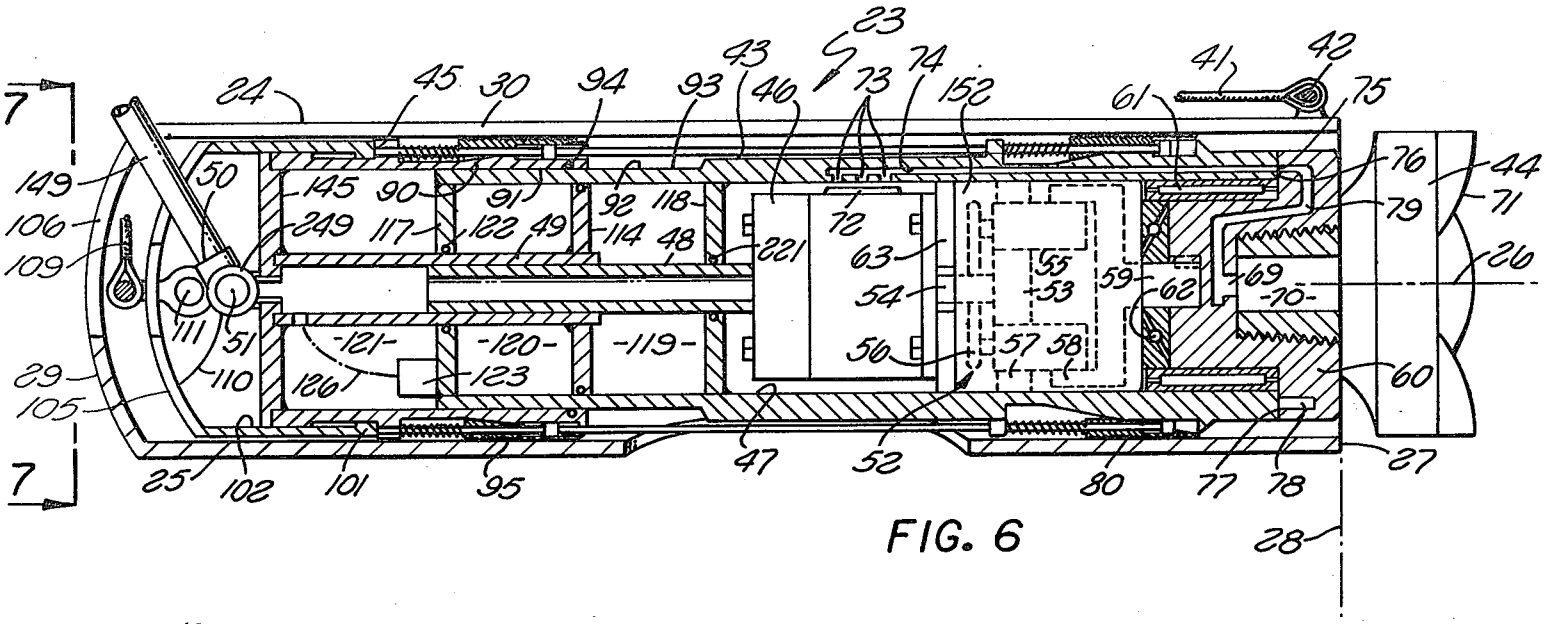
FIG. 6 is an enlarged axial section through the drilling unit and its carrier.
Figure 6A:
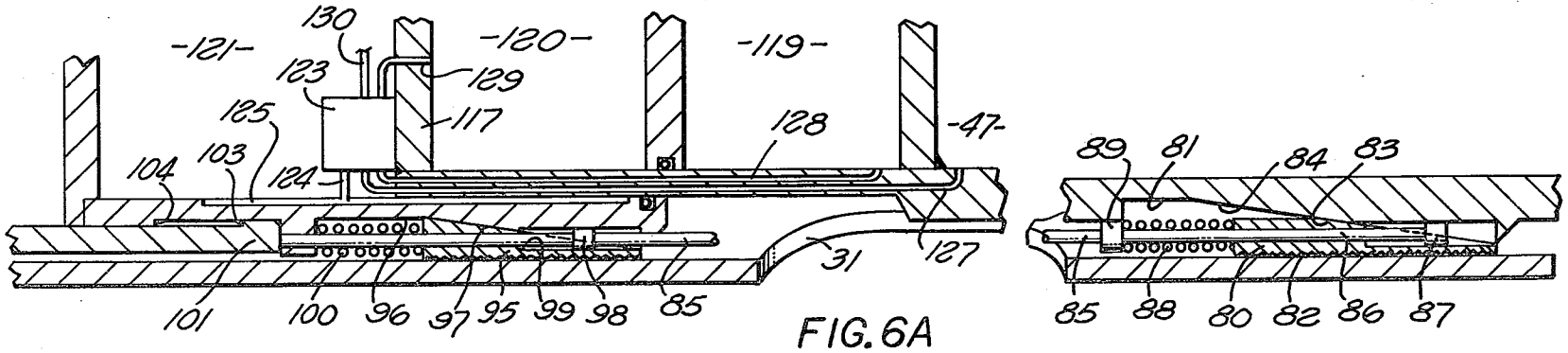
FIG. 6A is a detail view showing a portion of FIG. 6 in enlarged form.

Referring now to FIG. 6, the self-advancing drilling unit 23 includes a main body 43 to which a drilling bit 44 is mounted for powered rotation about axis 26, and a second body 45 which acts as a backing structure for transmitting reactive forces of the bit to the earth formation to enable the drilling unit to be self-propelling through the earth. The bit is driven by a motor 46 which is contained within a hollow cylindrical chamber 47 formed in body 43 and is energized by compressed air delivered to the motor by a cylindrical inlet tube 48 rigidly secured to body 43. A second cylindrical tube 49 is rigidly secured to body 45 by attachment to a transverse wall 145 of that body and is slidably telescopically movable relative to tube 48 along axis 26 to deliver air thereto in different relative axial positions of the bodies 43 and 45. The inlet end of tube 49 is connected to a flexible compressed air supply hose 149 by a swivel connection 249 including a fitting 50 which pivots relative to wall 145 and tube 49 about an axis 51 disposed transversely of and intersecting main axis 26 of the drill unit. The motor drives the bit through a speed reduction gear assembly 52, preferably taking the form of a planetary gear arrangement having a very high speed reduction ratio, desirably on the order of 100 to 1. The planetary assembly is illustrated diagrammatically in FIG. 6 as including a housing 152 containing a sun gear 53 carried and driven by the shaft 54 of motor 46, a number of circularly spaced planet gears 55 mounted rotatably to a planet carrier 56, a non-rotating ring gear 57 fixed to housing 152 and having internal teeth meshing with the planets, and a second ring gear 58 having internal teeth meshing with the planets and connected to an output shaft 59 which drives the bit. The two ring gears 57 and 58 have slightly different numbers of teeth so that while gear 57 is stationary the gear 58 is driven rotatively about axis 26 but at a very slow speed relative to input shaft 54. For example, if sun gear 53 has 10 teeth and planets 55 have 18 teeth each, and if ring gears 57 and 58 have 46 teeth and 44 teeth respectively, the desired 100 to 1 speed reduction ratio is attained.

Bit 44 is connected threadedly into a rotary part 60 which is connected to and is keyed for rotation with output shaft 59 of the transmission. Part 60 and the bit are journalled rotatively by a bearing 61 and are retained against axial movement (leftwardly in FIG. 6) by a thrust bearing 62, which may transmit axial forces through the housing of transmission 52 to a transverse wall 63 secured rigidly to body 43.

Bit 44 receives pressurized air exhausted from motor 46 through a passage 69 delivering air to an axial passage 70 in the bit which in turn discharges the compressed air adjacent the cutters 71 of the bit to produce a flow of air acting to carry cuttings back from the bit about the outside of the drilling unit and ultimately into sump 17 at the bottom of the main well bore. The air discharged from motor 46 leaves the housing of the motor at 72, and then flows (still at superatmospheric pressure) through a number of openings 73 and an axial passage 74 formed in the side wall of body 43 to an opening 75 formed in a transverse annular forward face 76 of body 43. The bit carrying part 60 has a transverse annular face 77 engaging surface 76 and containing an annular groove 78 centered about axis 26 in a relation maintaining communication between groove 78 and passage 74 continuously for flow of the pressurized air from motor 46 through a passage 79 in part 60 to previously mentioned discharge passage 69 leading to the bit.

Near its forward end, the tubular main body 43 movably carries a number of evenly circularly spaced slip elements 80 (typically four such slip elements), which are mounted for limited axial and radial movement within individual recesses 81 formed in the outer surface of body 43. Each slip has gripping teeth 82 at its radially outer side, curving about axis 26 to grip radially outwardly against the wall of a horizontal hole 22 formed by the drilling unit in a manner preventing axial retracting movement (leftwardly in FIG. 6) of body 43. Each slip 80 has a radially inner camming surface 83 engaging an outer camming surface 84 on body 43, with these two surfaces 83 and 84 being inclined with respect to axis 26 at a camming angle to advance progressively inwardly as they advance leftwardly in FIG. 6, to thereby cam the slips radially outwardly into increasingly tighter gripping engagement with the side wall of the drilled hole in response to any tendency for leftward movement of main body 43. The slips do not, however, resist rightward movement of main body 43 as the bit 44 drills more deeply into the earth formation. Associated with each of the slips 80, there is provided a rod 85 which extends parallel to axis 26 and extends through an axial passage 86 in the corresponding slip, and has an enlarged head 87 engageable with a shoulder on the slip beyond passage 86 to enable the slip to be pulled in a releasing direction (leftwardly in FIG. 6) by the exertion of pulling force on rod 85. Springs 88 disposed about these rods between the slips and lugs 89 formed on body 43 resist such retracting movement of the slips and normally urge them into tight gripping engagement with the wall of a drilled hole. Each rod 85 extends through an opening in the corresponding lug 89, and is axially movable therein to enable the discussed retraction of the slip by the rod.

The second body part 45 of the drilling unit has a tubular side wall 90 centered about axis 26 and having an internal cylindrical surface 91 slidably received about and closely fitting an external cylindrical surface 92 on a reduced diameter rear portion 93 of body 43. An annular deformable seal ring 94 forms a fluid-tight seal between these relatively axially movable parts. Externally, part 45 movably carries a number of evenly circularly spaced slips 95 which may be the same as slips 80 and are axially and radially movable within individual recesses 96 in part 45. Camming surfaces 97 on slips 95 and part 45 are inclined in correspondence with surfaces 83 and 84 of the forward slips and part 43, to prevent leftward retracting movement of body 45 within a drilled hole while permitting rightward advancing movement of that part. Each of the slips 95 is aligned axially with a corresponding one of the slips 80, and the rod 85 from that forward slip 80 extends rearwardly through the corresponding rear slip 95, with an enlargement 98 on the rod being engageable with a shoulder 99 on the slip 95 to transmit leftward retracting movement of the rod to the slip. As in the case of the forward slips, each of the rear slips 95 has a coil spring 100 which urges it forwardly to its gripping position, and may be disposed about the associated rod 85.

Figure 7:
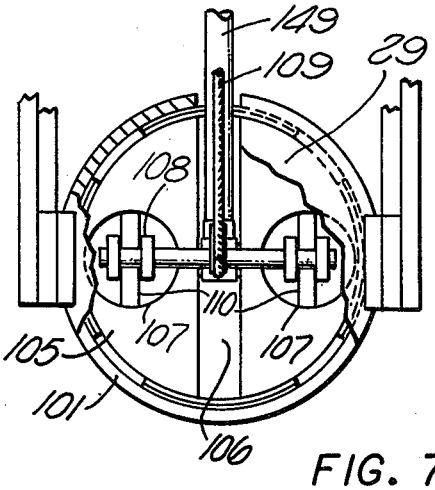
FIG. 7 is a reduced end view taken on line 7–7 of FIG. 6, with the outer carrier partially broken away.

The back ends of rods 85 may all be rigidly secured to a retracting cap 101, having a cylindrical wall 102 slidably received about part 45, and having an annular stop flange 103 engageable with a shoulder 104 formed on part 45 to limit the leftward retracting movement of cap 102 relative to part 45. The end wall 105 of retracting cap 101 may be curved convexly in correspondence with the curvature of the previously described end wall of the carrier, to be receivable in close proximity thereto during lowering of the parts into a well and until the horizontal drilling operation commences. Cap 101 is free for movement leftwardly far enough to retract all of the slips 80 and 95 away from gripping engagement with the side wall of a drilled hole, to thus permit the entire drilling unit to be pulled out of the hole. Cap 101 contains a diametrically extending slot 106 within which hose 149 is receivable in a manner enabling the hose to swing from a position of longitudinal alignment with axis 26 to a position of extension transversely of that axis. The end wall 105 of cap 101 also contains a pair of openings 107 (FIG. 7) through which a pair of clevises 108 connected to a withdrawal cable 109 attach to cap 101. As seen in FIGS. 6 and 7, the cap 101 may carry at the location of each of the openings 107 a part 110 rigidly attached to the cap 101 and to which the corresponding clevis 108 is attached by a pin 111. The cable 109 and air supply hose 48 both extend upwardly to the surface of the earth, and are windable about a drum or drums 112 (FIG. 1) to which the compressed air may be supplied from a source represented at 113.

For actuating the bit axially relative to backup body 45, the rear portion of the main body 43 of the drilling unit functions as a cylinder containing a power piston 114 connected rigidly to the previously mentioned tube 49 which therefore functions as a piston rod rigidly secured to body 45 through wall 145. Parts 114, 49, 145 and 45 are thus all rigidly secured together to form a composite unit relative to which the forward or main body 43 is axially movable. The opposite ends of the cylinder formed within the rear portion 93 of body 43 are closed by two transverse end walls 117 and 118 appropriately welded or otherwise rigidly secured to body 43 to form two variable size cylinder chambers 119 and 120 at the front and rear sides respectively of the piston. A seal ring 221 forms a fluid-tight seal between wall 118 and the external surface of air supply tube 48, and a seal ring 122 forms an annular fluid-tight seal between wall 117 and the relatively axially movable piston rod tube 49 contained therein.

A third cylinder chamber 121 is formed within the interior of body part 45 axially between the two walls 117 and 145 and about tube 49. Pressure introduced into this chamber acts to supplement pressure introduced into chamber 119 in causing advancement of body 43 and the bit relative to body 45, while the single intermediate chamber 120 acts when pressurized to move body 45 forwardly relative to body 43.

Compressed air is admitted alternately to cylinder chamber 120 and the two chambers 119 and 121 by an automatic valve 123, in a relation causing reciprocation of body 43 and the carried parts relative to body 45. Valve 123 may be of any conventional type for effecting such reciprocation, and is typically illustrated as having a body attached rigidly to wall 117, and having an actuating element 124 movable relative to the body of the valve to control flow of air to and from the various chambers. Actuating element 124 of the valve may project radially outwardly into an elongated axially extending groove 125 formed in the inner surface of the tubular side wall of body 45, with element 124 being engageable with the opposite ends of groove 125 to shift element 124 and actuate the valving mechanism when relatively movable parts 43 and 45 reach opposite ends of their reciprocating movement. Air may be supplied to valve 123 from the interior of tube 49 through a flexible hose or other connection diagrammatically represented at 126. Discharge air received by valve 123 from the various chambers 119, 120 and 121 is conducted from the valve through a passage diagrammatically represented at 127 to chamber 47 within body 43. Valve 123 communicates with the three chambers 119, 120 and 121 through passages or conduits represented at 128, 129 and 130. As will be understood, during rightward movement of body 43 and the carried bit relative to backup body 45, compressed air is admitted by valve 123 to chambers 119 and 121, and is discharged by that valve from chamber 120. When body 43 reaches the end of its rightward range of travel, valve 123 is automatically actuated to reverse the air connections and supply compressed air to chamber 120 while exhausting air from chambers 119 and 121, to thus move body 45 rightwardly relative to body 43 until arrival at the end of the desired range of movement in that direction causes reversal again of the valve 123 by its actuating element 124 to again advance body 43 and the bit rightwardly relative to body 45.

Figure 9:
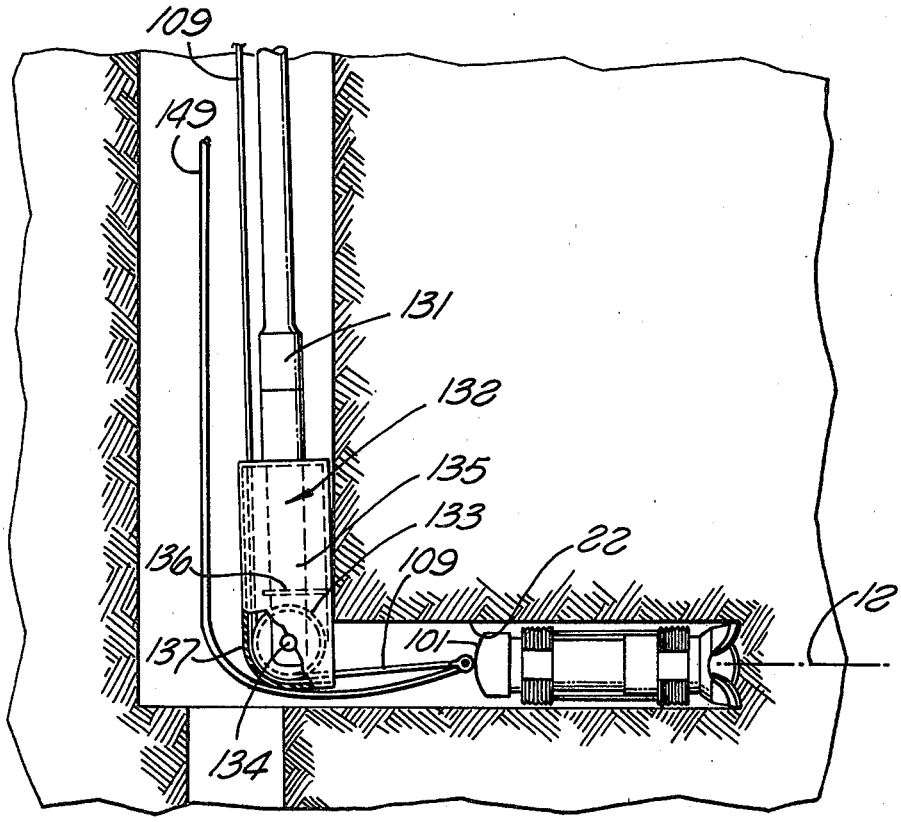
FIG. 9 illustrates the apparatus at a later stage of the drilling operation.

In addition to the parts thus far described, the apparatus of the present invention preferably also includes a cable guiding and withdrawal tool 131 (FIG. 9), which can be lowered into the well by drill string 211 after the drilling unit carrier 24 has been withdrawn upwardly. This tool 131 may include a part 132 threadedly connected to the lower end of the drill string and mounting a pulley wheel 133 for rotation relative to part 132 about an axis 134 extending transversely of the drill string and horizontally in the FIG. 9 condition. The pulling cable 109 connected to cap 101 of the drilling unit extends about the underside of pulley wheel 133, and then extends upwardly to the surface of the earth, so that with the pulley wheel located at the juncture of the main well bore and the laterally extending hole 22 it functions to guide the cable from a horizontal condition to a vertical condition in a manner preventing the cable from becoming lodged in the earth or adversely affecting the configuration of the drilled holes at the juncture of the main well bore and the lateral hole. A tubular shroud 135 may extend about the lower portion of part 132 and wheel 133, to protect these parts, and may be secured in any manner to part 132 as by connector brackets or plates represented at 136. The wall 137 of part 135 which curves about the left side and underside of wheel 133 is in sufficiently close proximity to the perimeter of the wheel to confine cable 109 between the wheel and wall 137 and prevent movement of the cable laterally from within the peripheral groove in the pulley wheel.

To now describe the complete process which may be involved in utilizing the above discussed apparatus, a first step is of course to drill a vertical main well bore 10 and to underream its lower end portion to an increased diameter as represented at 16 in FIG. 1. A second similar hole may be drilled at a location spaced from bore 10, with the intention then being to drill a horizontal hole along the axis 12 of FIG. 1 between the two vertical bores. Both of the vertical wells may be encased as represented at 18.

Figure 2:
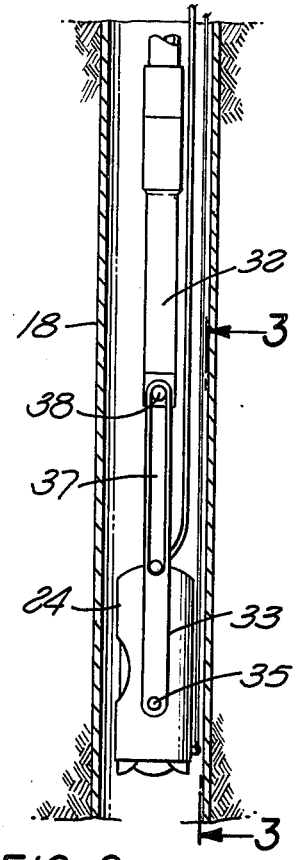
FIG. 2 is an enlarged view of the drilling unit of FIG. 1.
Figure 3:
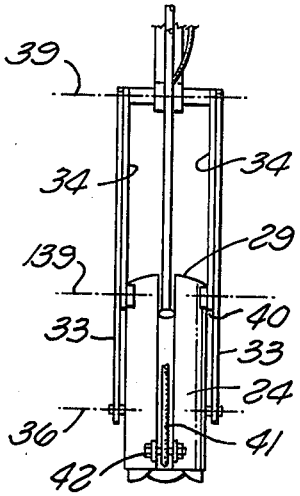
FIG. 3 is a view taken on line 3—3 of FIG. 2.

After the vertical bores have been prepared, the assembly 21 is connected to the lower end of the drill string 211, and is lowered into bore 10 in the condition illustrated in FIG. 2, and in full lines in FIG. 1. In this condition, carrier 24 and the contained drilling unit 23 are disposed vertically, that is, with their axis 26 disposed vertically and longitudinally of the well bore 10, to occupy a minimum transverse dimension and thus enable such lowering of the elongated assembly into the well.

Figure 4:
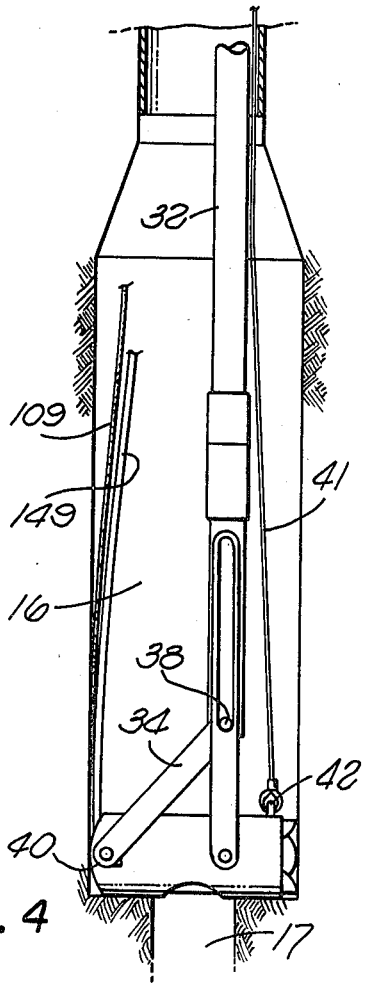
FIG. 4 illustrates the drilling unit of FIG. 1 positioned for drilling a hole laterally into the earth formation.

When the assembly 21 reaches the enlarged diameter underreamed portion 16 at the bottom of bore 10, an operator pulls upwardly on cable 41 to swing carrier 24 and the drilling unit from the vertical position of FIG. 2 to the horizontal or transverse position of FIG. 4. In that condition, the drill string is lowered far enough to locate carrier 24 and the contained drilling unit on the bottom surface of the underreamed region, disposed directly transversely of the longitudinal axis of the main well bore, and the apparatus is held in this condition as the horizontal drilling operation is commenced by admission of compressed air to inlet tubes 49 and 48 through hose 149. The air in tube 48 causes motor 46 to drive bit 44 rotatively through the planetary gear assembly 52, to commence a horizontal drilling operation. At the same time, the air acts through the piston and cylinder mechanism to commence advancement of main body 43 and the carried bit relative to the backup body 45.

At the time of lowering of the drilling unit into the hole, the body 43 is retracted relative to body 45 to a condition in which the overall drilling unit is of minimum axial length. When the air is first turned on by opening of a control valve 138 at the surface of the earth, valve 123 acts to admit air to chambers 119 and 121, tending to force wall 118 forwardly relative to piston 114, and similarly urging wall 117 forwardly relative to wall 145, to thus essentially double the force which could be exerted by one of these cylinder chambers separately and thereby very effectively urge the bit forwardly, from the full line position of FIG. 5 to the broken line position of that figure to commence the drilling of the horizontal hole. During this initial drilling step, rearward movement of the body 45 is resisted both by engagement of slips 95 with the wall of carrier 24, and by engagement of cap 101 with end wall 29 of the carrier. Forward slips 80 can move rearwardly a short distance relative to main body 43 of the drilling unit, against the tendency of the springs 88, to permit the forward drilling advancement of body 43.

Figure 5:
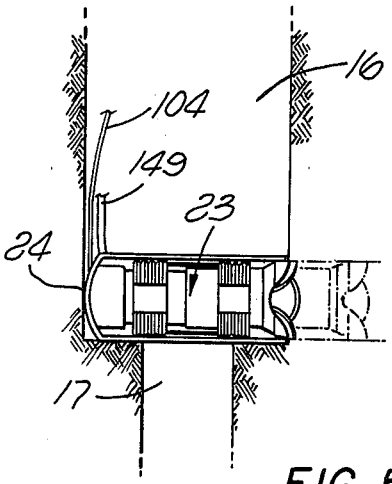
FIG. 5 is a view similar to FIG. 4, but with the carrier for the drilling unit broken away to reveal the drilling unit therein.
Figure 8:
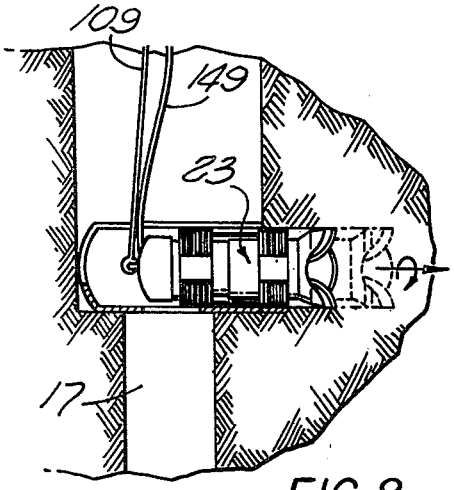
FIG. 8 is a view similar to FIG. 5, but showing the drilling unit after advancement a short distance into the earth formation.

When body 43 reaches the broken line position of FIG. 5, the automatic air valve 123 reverses the connections to the cylinder chambers, exhausting air from chambers 119 and 121 and applying pressure to chamber 120, to cause forward movement of backup body 45 and its slips relative to the main body 43. This forward advancement of the body 45 continues until it reaches the position of FIG. 8, at which time the valve again reverses the supply and exhaust connections to the cylinder chambers to move body 43 and bit 44 forwardly from the full line position of FIG. 8 to the broken line position of that figure, with the backup or reactive forces being transmitted by the rear slips 95 to the cylindrical side wall of carrier 24. Such movement of the two bodies 43 and 45 alternately toward one another and then away from one another acts to progressively advance the drilling unit from the FIG. 8 position to and beyond a position such as that represented in FIG. 9, to drill a straight horizontal hole into the earth, with the reactive forces of the drilling operation being transmitted directly to the earth by slips 95.

As soon as the drilling unit reaches a position in which it is entirely out of carrier 24, the carrier can be withdrawn upwardly from the well, and the tool 131 can be lowered into the well, with the cable 109 extending about wheel 133 and threaded between that wheel and wall 137 of the shroud 135. This tool is lowered to the position illustrated in FIG. 9 in which wheel 133 thereafter acts to guide the cable through a right angle between its vertical and horizontal conditions at the juncture of the main well bore and the lateral bore 22. The length of the lateral hole can be determined by measurement of the amount of the cable 109 which is fed out, and when a desired horizontal length has been attained the entire drilling unit 23 can be pulled horizontally within hole 22 back toward the main bore 10 by exertion of pulling force on cable 109. Such pulling force acts to move retrieval cap 101 leftwardly relative to body 45 as viewed in FIG. 6, far enough to retract slips 80 and 95 away from tight gripping engagement with the side wall of hole 22, and thus avoid interference by those slips with retraction of the drilling unit. When the drilling unit reaches a point at which it contacts or essentially contacts wheel 133, the drill string 211 and cable 109 may both be pulled upwardly together to withdraw the entire tool 131 and the connected drilling unit from the well. During such withdrawal, the drilling unit will hang vertically to be easily movable upwardly through the reduced diameter portion of the well.

While a certain specific embodiment of the present invention has been disclosed as typical, the invention is of course not limited to this particular form, but rather is applicable broadly to all such variations as fall within the scope of the appended claims.

We claim:

1. A self-propelling drilling unit, comprising:

a drilling element operable to drill a hole within the earth;

first slip means having radially outer gripping surfaces engageable with the earth about said hole to transmit axial reactive forces from the drilling element to the earth and having radially inner tapering cam surfaces;

power actuated means operable alternately to first advance said drilling element relative to said first slip means in a first drilling step to form a portion of the hole, and then advance said first slip means relative to the drilling element in preparation for another drilling step;

second slip means having radially outer gripping surfaces engageable with the earth about said hole and having radially inner tapering cam surfaces and which are advanceable with said drilling element;

tapering camming surfaces engageable with said cam surfaces of said first slip means to cam said first slip means radially outwardly against the earth in a relation preventing axial retracting movement of said first slip means during said advancement of the drilling element, but permitting forward movement of said first slip means; and additional tapering camming surfaces engageable with said cam surfaces of said second slip means to cam said second slip means radially outwardly against the earth about said hole to prevent rearward movement of the second slip means and drilling element during said advancement of the first slip means, but permitting said advancement of the second slip means and said drilling element.

2. A drilling unit as recited in claim 1, including means for releasing both of said first and second slip means from holding engagement with the earth about said hole and thereby permitting withdrawal of the drilling unit from the hole.

3. A drilling unit as recited in claim 1, including at least one elongated axially movable part operable to release both of said first and second slip means from holding engagement with the earth about said hole to permit withdrawal of the drilling unit from the hole, and a line operable by pulling force exerted from the surface of the earth to actuate said element and release the slip means.

4. A drilling unit as recited in claim 1, in which said drilling element is a rotary bit, said self-propelling unit including a motor driving said bit.

5. The combination comprising:

a drilling unit adapted to be lowered into a well and to drill into the earth; and a carrier adapted to hold the drilling unit and to be lowered into the well therewith and from which the drilling unit is advanceable to drill into the earth;

said drilling unit including a drilling element; gripping means engageable with a wall of said carrier during an initial part of a drilling operation in a relation transmitting axial reactive forces of the drilling unit to said carrier, and engageable with the earth formation about the drilled hole during a later part of the drilling operation to then transmit said reactive forces directly to the earth; and power actuated means operable alternately to first advance said drilling element relative to said gripping means and then advance said gripping means relative to the drilling element.

6. The combination as recited in claim 5, in which said drilling unit includes additional gripping means engageable with the earth to prevent axial retracting movement of the drilling element during said advancement of said first mentioned gripping means.

7. The combination as recited in claim 5, in which said drilling element is a rotary bit, and said unit includes a motor driving said bit.

8. The method that comprises:

lowering into a main well bore a drilling unit and a carrier holding said unit, with said drilling unit and carrier extending generally longitudinally of the main well bore as they are lowered;

turning both the carrier and the drilling unit held thereby within the well from said generally longitudinally extending position to a position of extension more transversely of the main well bore;

advancing said drilling unit from said carrier to drill a hole extending laterally from the main well bore; and actuating the drilling unit to grip the wall of said hole and apply reactive forces from the drilling unit thereto as the hole is drilled.

9. The method as recited in claim 8, including actuating said drilling unit to grip a wall of said carrier during the initial advancement of the drilling unit to apply said reactive forces to the carrier.

10. The method as recited in claim 8, including withdrawing said carrier upwardly from the main well bore while the drilling unit remains in said lateral hole.

11. The method as recited in claim 8, including withdrawing said carrier upwardly from the main well bore while the drilling unit remains in said lateral hole, and subsequently withdrawing said drilling unit from the hole and main well bore.

12. The method as recited in claim 8, including withdrawing said carrier upwardly from the main well bore while the drilling unit remains in said lateral hole, lowering a recovery tool into the main well bore to essentially the juncture of the main well bore and said lateral hole, and withdrawing said drilling unit from the lateral hole by force exerted through a cable directed by the recovery tool from a laterally extending condition to a longitudinally extending condition relative to the main well bore.

13. A drilling unit comprising:

a drilling element;

first drilling means for engaging a bore wall to transmit reactive forces thereto;

a piston and cylinder structure operable alternately to first advance said drilling element relative to said gripping means to drill a portion of a hole and then advance said gripping means in preparation for a next drilling step;

said piston and cylinder structure containing different cylinder chambers for exerting force to advance the drilling element and gripping means respectively, and having more cylinder chambers for advancing the drilling element than for advancing the gripping means.

14. A drilling unit as recited in claim 13, in which said piston and cylinder structure includes a first cylinder structure connected to said drilling element to apply advancing force thereto, a piston in said first cylinder structure connected to said gripping means and defining two of said cylinder chambers at opposite sides thereof, and a second cylinder structure at an end of said first cylinder structure and telescopically movable relative thereto and connected to said gripping means and containing the third of said cylinder chambers.

15. The combination comprising:

a self-propelling unit adapted to be lowered into a main well bore and to drill a hole extending laterally therefrom;

said unit including a drilling element operable to drill generally along an axis, gripping means engageable with the earth about said laterally extending hole in a relation transmitting axial reactive forces from the drilling element to the earth, and power actuated means for advancing said drilling element relative to said gripping means to progressively form the hole; and means mounting said unit, including said drilling element, said gripping means and said power actuated means, to turn from a first position in which said axis of the drilling element extends generally longitudinally of the main well bore to a drilling position in which said axis is disposed more transversely of the main well bore to drill said lateral hole;

said mounting means including a carrier adapted to hold said self-propelling unit and to be lowered into said main well bore therewith and from which said unit is advanceable to drill said lateral hole.

16. The combination as recited in claim 15, in which said mounting means include a connection mounting said carrier and said unit held thereby for swinging movement together between said first position and said drilling position of said unit.

17. The combination as recited in claim 15, in which said carrier has a wall engageable by said gripping means in an initial portion of the drilling advancement of said unit into said lateral hole to transmit said reactive forces to said carrier.

18. The combination as recited in claim 15, including a string of pipe extending downwardly within said main well bore, said mounting means connecting said self-propelling unit to a lower end of said pipe string for essentially pivotal movement relative to the pipe string between said first position and said drilling position.

19. The combination as recited in claim 15, in which said power actuated means are operable alternately to first advance said drilling element relative to said gripping means and then advance said gripping means relative to said drilling element, said unit including additional gripping means engageable with the earth about said hole to prevent rearward movement of said element in the hold during relative advancement of said first mentioned gripping means.

20. The combination as recited in claim 19, in which said two gripping means are formed as tapered slips each movable forwardly within the hole but adapted to grip the earth about the hole in a relation preventing reverse retracting movement.

21. The combination as recited in claim 20, including means for simultaneously retracting both of said gripping means to enable withdrawal of said unit from said hole.

22. The combination as recited in claim 15, including a flexible line connected to said self-propelling unit and adapted to exert pulling force for withdrawing the unit from the hole and from said main well bore.

23. The combination as recited in claim 15, including means for retracting said gripping means from holding engagement with the earth about said lateral hole.

24. The combination as recited in claim 15, in which said unit includes a part connectable to a line extending to the surface of the earth and adapted to be actuated by said line, and means for retracting said gripping means in response to movement of said last mentioned part.

25. The combination as recited in claim 15, including a flexible line connected to said self-propelling unit to withdraw it from the hole, and a recovery tool lowerable into the main well bore and having a line guiding element receivable at essentially the juncture of said main well bore and said lateral hole and about which said line extends to direct it from a condition of extension longitudinally within the main well bore to a laterally extending condition in said hole.

26. The combination as recited in claim 25, in which said line guiding element is a wheel about which the line is directed at the juncture of the main bore and said hole.

27. The combination comprising:

a self-propelling unit adapted to be lowered into a main well bore and to drill a hole extending laterally therefrom;

said unit including a drilling element operable to drill generally along an axis, gripping means engageable with the earth about said laterally extending hole in a relation transmitting axial reactive forces from the drilling element to the earth, and power actuated means for advancing said drilling element relative to said gripping means to progressively form the hole; and means mounting said unit, including said drilling element, said gripping means and said power actuated means, to turn from a first position in which said axis of the drilling element extends generally longitudinally of the main well bore to a drilling position in which said axis is disposed more transversely of the main well bore to drill said lateral hole;

said mounting means including a carrier adapted to hold said self-propelling unit and to be lowered into the main well bore therewith, a supporting part, a connection attaching said carrier at a first location to said supporting part for swinging movement of the carrier and said unit held thereby between said first position and said drilling position of said unit, and means for exerting upward pulling force on said carrier at a second location in a relation swinging the carrier between said positions.

28. The combination as recited in claim 27, in which said mounting means include means limiting said swinging movement in said drilling position.

29. The combination comprising:

a self-propelling unit adapted to be lowered into a main well bore and to drill a hole extending laterally therefrom;

said unit including a drilling element operable to drill generally along an axis, gripping means engageable with the earth about said laterally extending hole in a relation transmitting axial reactive forces from the drilling element to the earth, and power actuated means for advancing said drilling element relative to said gripping means to progressively form the hole; and means mounting said unit, including said drilling element, said gripping means and said power actuated means, to turn from a first position in which said axis of the drilling element extends generally longitudinally of the main well bore to a drilling position in which said axis is disposed more transversely of the main well bore to drill said lateral hole;

said mounting means including a part to be connected to the lower end of a string of well pipe, a carrier adapted to hold said unit as it is lowered into said main well bore and from which the unit is advanceable to drill said lateral hole, a first link connected pivotally at different locations to said part and said carrier and mounting the carrier and unit for swinging movement together between said first position and said drilling position of the unit, and an additional link having connections at spaced locations with said part and said carrier with one of said connections being a pin and slot connection limiting said swinging movement in said drilling position.

30. The combination as recited in claim 29, including a line connected to said carrier and operable to exert upward pulling force thereagainst at a location and in a relation to swing the carrier to said drilling position.

31. The combination comprising:

a self-propelling drilling unit adapted to be lowered into a main well bore and to drill a hole extending laterally therefrom;

said unit including a drill bit rotatable about an axis, a motor for rotating said bit about said axis, gripping means engageable with the earth about said laterally extending hole in a relation transmitting axial reactive forces from the bit to the earth, and power actuated means for advancing said rotating bit relative to said gripping means to progressively form said hole; and means mounting said self-propelling drilling unit, including said bit, motor, gripping means and power actuated means, to turn from a first position in which said axis of the bit extends generally longitudinally of the main well bore to a drilling position in which said axis is disposed more transversely of the main well bore to drill said lateral hole;

said mounting means including a carrier adapted to hold said drilling unit and to be lowered into said main well bore therewith and from which the drilling unit is advanceable to drill said lateral hole, and a connection mounting said carrier and the drilling unit held thereby for swinging movement together between said first position and said drilling position of the drilling unit.

32. The combination as recited in claim 31, in which said power actuated means include a piston and cylinder structure operable alternately to first advance said bit relative to said gripping means and then advance said gripping means relative to said bit, said unit including additional gripping means engageable with the earth about said hole to prevent rearward movement of said bit in the hole during relative advancement of said first mentioned gripping means.

33. The combination as recited in claim 32, in which said two gripping means are formed as tapered slips each movable forwardly within the hole but adapted to grip the earth about the hole in a relation preventing reverse retracting movement, there being means operable by pulling force exerted from the surface of the earth for retracting both of said gripping means to enable withdrawal of said unit from said hole.

34. The combination as recited in claim 33, in which said carrier has a wall engageable with said first mentioned gripping means during initial advancement of the drilling unit into said hole to initially apply said axial reactive forces to the carrier.

35. The combination as recited in claim 31, in which said power actuated means are operable alternately to first advance said bit relative to said gripping means and then advance said gripping means relative to said bit, said unit including additional gripping means engageable with the earth about said hole to prevent rearward movement of said bit in the hole during relative advancement of said first mentioned gripping means.

36. The combination as recited in claim 35, in which said two gripping means are formed as tapered slips each movable forwardly within the hole but adapted to grip the earth about the hole in a relation preventing reverse retracting movement, there being means for retracting both of said gripping means to enable withdrawal of said unit from said hole.

37. The combination as recited in claim 31, including means for retracting said gripping means for holding engagement with said wall of the lateral hole.

38. The combination as recited in claim 31, including a flexible line connected to said drilling unit to withdraw it from the hole and main well bore, and a recovery tool lowerable into the main well bore and having a line guiding rotary element receivable at essentially the juncture of said main well bore and said lateral hole and about which said line extends to direct it from a condition of extension longitudinally of and within the main well bore to a laterally extending condition in the hole.

* * * * *